US009748671B2

(12) United States Patent
Takabayashi

(10) Patent No.: US 9,748,671 B2
(45) Date of Patent: Aug. 29, 2017

(54) TERMINAL CONNECTION STRUCTURE

(71) Applicant: Mitsubishi Electric Corporation, Chiyoda-ku, Tokyo (JP)

(72) Inventor: Hirokazu Takabayashi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/319,089

(22) PCT Filed: Jun. 16, 2014

(86) PCT No.: PCT/JP2014/065895
§ 371 (c)(1),
(2) Date: Dec. 15, 2016

(87) PCT Pub. No.: WO2015/193944
PCT Pub. Date: Dec. 23, 2015

(65) Prior Publication Data
US 2017/0125921 A1 May 4, 2017

(51) Int. Cl.
*H01R 11/11* (2006.01)
*H01R 4/30* (2006.01)
(Continued)

(52) U.S. Cl.
CPC ..... *H01R 4/308* (2013.01); *H01R 4/06* (2013.01); *H01R 4/34* (2013.01)

(58) Field of Classification Search
CPC ..... H01R 4/308
(Continued)

(56) References Cited

U.S. PATENT DOCUMENTS 4,361,371 A * 11/1982 Williams ..... H01R 9/2425 361/752
4,640,639 A * 2/1987 Matsui ..... F16B 21/04 174/138 D
(Continued)

FOREIGN PATENT DOCUMENTS

JP 2-205386 A 8/1990
JP 4-345082 A 12/1992
(Continued)

OTHER PUBLICATIONS

International Search Report (PCT/ISA/210) issued on Jul. 8, 2014, by the Japanese Patent Office as the International Searching Authority for International Application No. PCT/JP2014/065895.
(Continued)

*Primary Examiner* — Neil Abrams
(74) *Attorney, Agent, or Firm* — Buchanan Ingersoll & Rooney PC

(57) ABSTRACT

A terminal connection structure for electrically connecting a conductor and at least one terminal electrode of an electronic component, wherein the terminal electrode includes a plurality of connection terminals, the terminal connection structure includes a male part that includes a hole portion into which a fastening member, which may be threaded, is inserted, and a female part into which the male part is inserted and that includes hole portions equivalent in number to the connection terminals, the conductor is secured by being sandwiched between the female part and the male part and swaging the hole portion of the male part, and the conductor is secured to the electronic component with the fastening member inserted into the hole portion of the male part and fastening mechanisms, which may be threaded, provided to the respective connection terminals.

11 Claims, 6 Drawing Sheets

(51) Int. Cl.
*H01R 4/06* (2006.01)
*H01R 4/34* (2006.01)

(58) Field of Classification Search
USPC ..... 439/84, 97, 741, 801, 883, 210, 212; 361/803, 804; 29/761, 844
See application file for complete search history.

(56) References Cited

U.S. PATENT DOCUMENTS 4,753,615 A * 6/1988 Weidler ..... H01R 25/142 439/775
5,018,982 A * 5/1991 Speraw ..... H05K 7/142 174/138 D
5,365,654 A * 11/1994 Moulton ..... F16B 19/04 257/E23.086
5,410,450 A 4/1995 Iida et al.
5,646,445 A * 7/1997 Masumoto ..... H01L 23/24 257/703
5,749,671 A * 5/1998 Chauquet ..... H01R 4/30 174/88 B
6,078,501 A * 6/2000 Catrambone ..... H02M 7/003 174/50
6,230,403 B1 * 5/2001 Skoolicas ..... H02M 3/00 174/117 FF
6,347,042 B1 * 2/2002 White ..... H05K 7/142 174/138 D
6,443,783 B1 * 9/2002 Beadle ..... H01R 9/2425 439/718
6,521,983 B1 * 2/2003 Yoshimatsu ..... H01L 25/072 257/678
6,793,502 B2 * 9/2004 Parkhill ..... H01L 23/50 257/E25.016
7,002,271 B2 * 2/2006 Reed ..... F16H 57/04 310/71
7,241,152 B2 * 7/2007 Charrier ..... H02G 5/00 411/166
7,425,144 B2 * 9/2008 Bader ..... H01R 13/187 361/611
7,559,810 B1 * 7/2009 Wu ..... H01R 4/34 439/709
7,593,239 B2 * 9/2009 Li ..... H05K 7/142 361/803
7,798,833 B2 * 9/2010 Holbrook ..... B60R 25/00 174/72 B
8,054,633 B2 * 11/2011 Suwa ..... B60L 1/003 361/637
8,133,607 B1 * 3/2012 Chen ..... H01M 2/1077 320/112
8,235,735 B2 * 8/2012 Oka ..... H01R 4/06 29/844
8,502,365 B2 * 8/2013 Onishi ..... H01L 23/24 257/678
8,526,195 B2 * 9/2013 Hublier ..... H01R 4/10 174/50
9,209,531 B2 * 12/2015 Erdle ..... H01R 31/06
9,350,088 B2 * 5/2016 Suzuki ..... H01M 2/206
2011/0003519 A1 1/2011 Oka et al.
2017/0125921 A1 * 5/2017 Takabayashi ..... H01R 4/308

FOREIGN PATENT DOCUMENTS

JP 5-160339 A 6/1993
JP 8-64976 A 3/1996
JP 2003-133515 A 5/2003
JP 2004-39256 A 2/2004
JP 2006-158142 A 6/2006
JP 2007-19372 A 1/2007
JP 2012-227038 A 11/2012
JP 2013-161518 A 8/2013
WO WO 2009/096013 A1 8/2009

OTHER PUBLICATIONS

Written Opinion (PCT/ISA/237) issued on Jul. 8, 2014, by the Japanese Patent Office as the International Searching Authority for International Application No. PCT/JP2014/065895.
English Translation of Office Action, dated Jun. 2, 2015, Notice of Rejection issued on Jun. 2, 2015 for Application No. 2015-513936.

* cited by examiner

FASTENING MEMBER SIDE

POWER MODULE SIDE

TERMINAL CONNECTION STRUCTURE

FIELD

The present invention relates to a terminal connection structure for electrically connecting a conductor and at least one terminal electrode of an electronic component.

BACKGROUND

A terminal connection structure that connects terminals of power devices by using a stacked conductor in which insulators and conductors are alternately superposed on each other near the terminal electrodes of the power devices is a well-known terminal connection structure for electrically connecting a conductor and terminal electrodes of an electronic component (for example, Patent Literature 1).

The terminal connection structure disclosed in Patent Literature 1 is such that male parts and female parts are brought into close contact with each other by swaging. The male parts are inserted into the contact-terminal insertion holes provided in the conductors and the insulators of the stacked conductor and the female parts are formed with a larger diameter than that of the contact-terminal insertion holes.

CITATION LIST

Patent Literature

Patent Literature 1: Japanese Patent Application Laid-open No. 2007-19372

SUMMARY

Technical Problem

The terminal connection structure disclosed in Patent Literature 1 described above is formed such that the swaging portions are formed into a circular shape so as to facilitate swaging. In recent power devices, some power semiconductor modules for high current applications have a plurality of fastening points on one terminal electrode on the module side. Because the fastening points are, for example, disposed one after another in a lateral direction, the module terminal is formed into, for example, a rectangular shape such that the fastening points are aligned.

It is possible to form a swaging structure in the conventional technologies into a rectangular shape in order to follow such a rectangular module terminal. However, with a rectangular swaging structure, it is difficult to evenly apply a swaging force over the entire perimeter of the rectangular shape, and thus it has been difficult to actually use a rectangular swaging structure.

Thus, a module terminal having a plurality of fastening points has a circular swaging portion at each fastening point and this reduces the contact area ratio that is the ratio of the contact area of the conductor and the terminal electrode at the swaging portions to the footprint of the terminal electrode in which the fastening points are aligned. Because the power module having a plurality of fastening points is often used for high current applications, a reduction in the contact area ratio poses a problem of an increase in the temperature of the contact portions. Therefore, there is a demand for a terminal connection structure that can increase the contact area ratio.

The present invention has been achieved in view of the above and an object of the present invention is to provide a terminal connection structure that can increase the contact area ratio.

Solution to Problem

In order to solve the above problems and achieve the object, an aspect of the present invention is a terminal connection structure for electrically connecting a conductor and at least one terminal electrode of an electronic component. The terminal electrode includes a plurality of connection terminals, the terminal connection structure includes a male part that includes a hole portion into which a fastening member is inserted, and a female part into which the male part is inserted and that includes hole portions equivalent in number to the connection terminals, the conductor is secured by being sandwiched between the female part and the male part and swaging the hole portion of the male part, and the conductor is secured to the electronic component with the fastening member inserted into the hole portion of the male part and fastening mechanisms provided to the respective connection terminals.

Advantageous Effects of Invention

According to the present invention, an effect is obtained where the contact area ratio can be increased and thus an increase in the temperature of the contact portion can be suppressed.

DESCRIPTION OF EMBODIMENTS

A terminal connection structure according to exemplary embodiments of the present invention will be explained below with reference to the accompanying drawings. The present invention is not limited to the following embodiments.

First Embodiment

Figure 1:
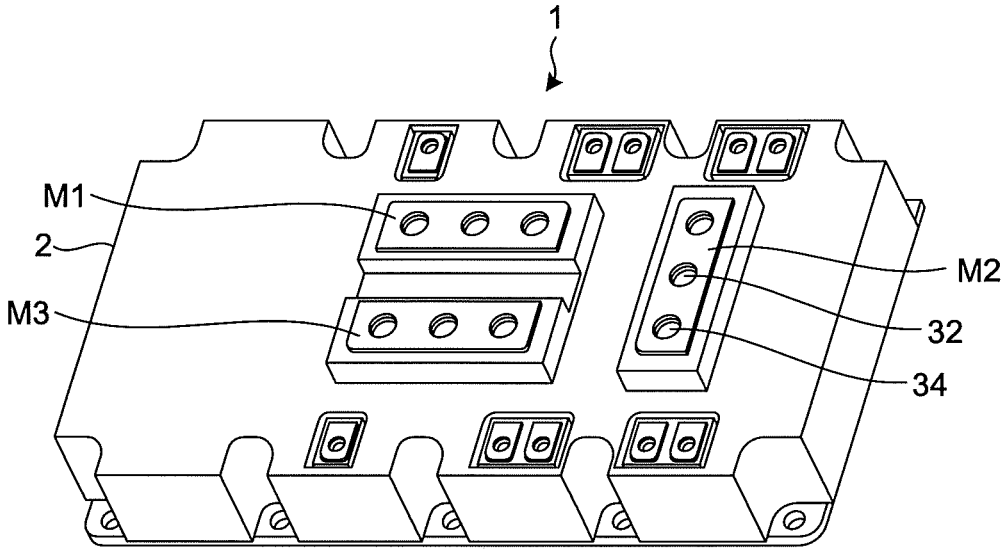
FIG. 1 is a perspective view illustrating a schematic shape of a power module suitable for explaining a terminal connection structure according to a first embodiment.
Figure 2:
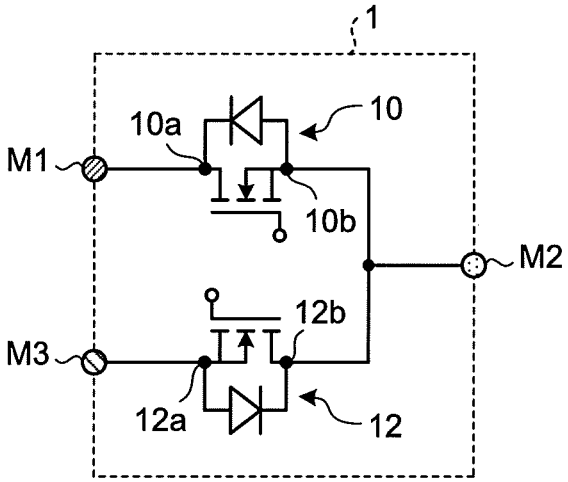
FIG. 2 is a circuit diagram of the power module illustrated in FIG. 1.

First, an explanation will be given, with reference to FIG. 1 and FIG. 2, of an electronic component that is to be connected by a terminal connection structure according to a first embodiment. FIG. 1 is a perspective view illustrating a schematic shape of a power module suitable for explaining the terminal connection structure according to the first embodiment. FIG. 2 is a circuit diagram of the power module illustrated in FIG. 1. The power module illustrated in FIG. 1 and FIG. 2 is an example of an electronic component and it is obvious that an electronic component other than a power module may also be connected.

As illustrated in FIG. 1 and FIG. 2, a power module 1 is configured such that a first element pair 10 and a second element pair 12 are accommodated in a package 2, which is a module housing. The first element pair 10 and the second element pair 12 are two element pairs in each of which a MOSFET operating as a switching element and a diode (hereinafter described as a "FWD") operating as what is called a flywheel diode are connected in anti-parallel with each other.

In the first element pair 10, the drain of the MOSFET and the cathode of the FWD are electrically connected to each other in the module to form a connection portion 10*a;* the terminal portion drawn out from the connection portion 10*a* forms a first terminal electrode M1; the source of the MOSFET and the anode of the FWD are electrically connected to each other in the module to form a connection portion 10*b;* and the terminal portion drawn out from the connection portion 10*b* forms a second terminal electrode M2. In the second element pair 12, the source of the MOSFET and the anode of the FWD are electrically connected to each other in the module to form a connection portion 12*a;* the terminal portion drawn out from the connection portion 12*a* forms a third terminal electrode M3; the drain of the MOSFET and the cathode of the FWD are electrically connected to each other in the module to form a connection portion 12*b;* and the connection portion 12*b* is electrically connected to the second terminal electrode M2.

The first terminal electrode M1, the second terminal electrode M2, and the third terminal electrode M3 are each formed into a rectangular shape and are provided on one main surface side of the package 2. The first terminal electrode M1 and the third terminal electrode M3 are disposed in the central portion of the package 2 such that their longitudinal direction is parallel to the longitudinal direction of the package 2 and they are aligned in a direction orthogonal to the longitudinal direction of the package 2. The second terminal electrode M2 is disposed on one end portion side in the longitudinal direction of the package 2 and is disposed such that its longitudinal direction matches the direction orthogonal to the longitudinal direction of the package 2. Each of the first terminal electrode M1, the second terminal electrode M2, and the third terminal electrode M3 is provided with three holes 32, and a nut 34, which is a fastening mechanism, is provided in each of the holes 32. The holes 32 and the nuts 34 constitute fastening points of the first terminal electrode M1, the second terminal electrode M2, and the third terminal electrode M3, which are terminal electrodes of the power module 1. The function of the nuts 34 will be described later.

Figure 3:
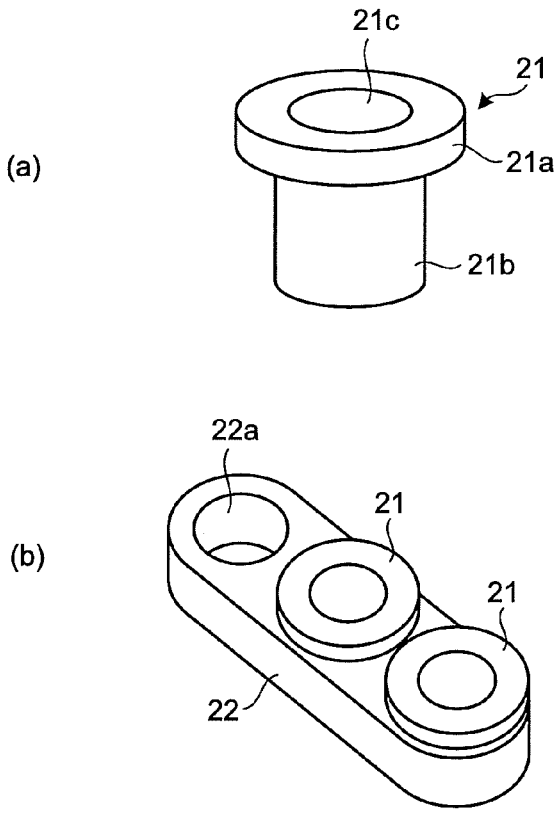
FIG. 3 is a perspective view illustrating the outer shape of the parts that are components of the terminal connection structure according to the first embodiment.
Figure 4:
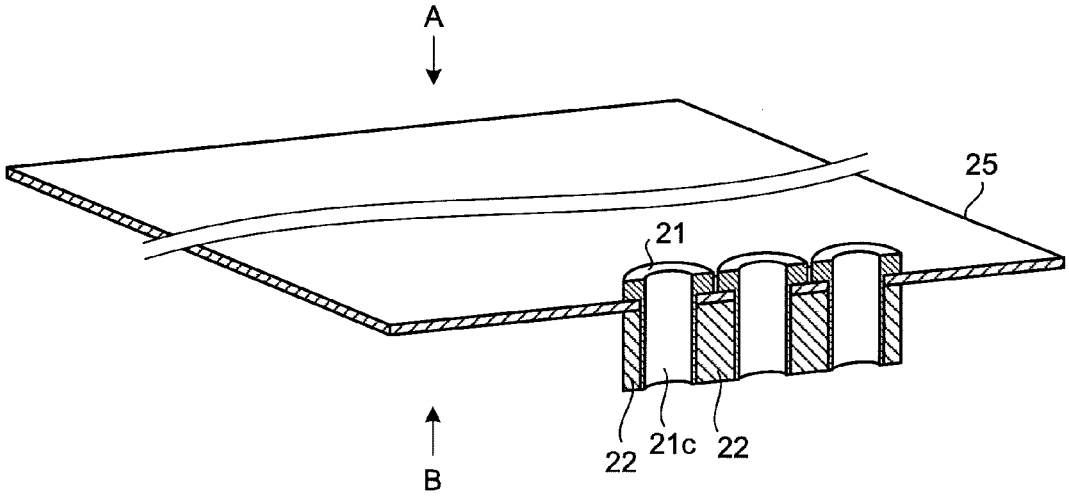
FIG. 4 is a partial cross-sectional perspective view illustrating an example when a conductor is swaged by using the terminal connection structure according to the first embodiment.
Figure 5:
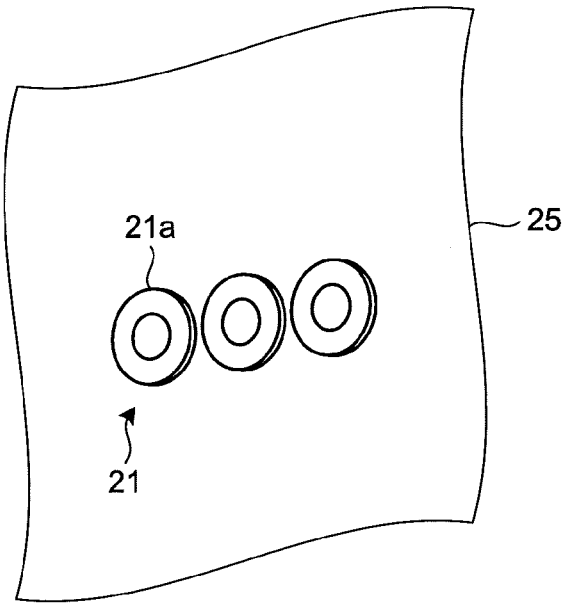
FIG. 5 is a perspective view when the example in FIG. 4 is viewed from a direction A in FIG. 4.
Figure 6:
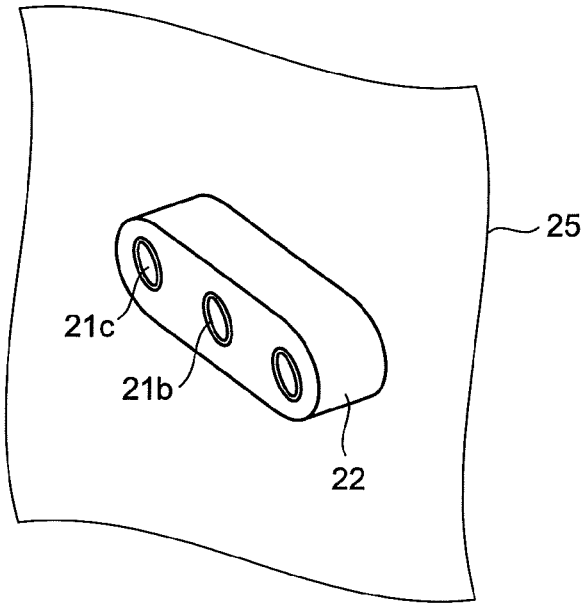
FIG. 6 is a perspective view when the example in FIG. 4 is viewed from a direction B in FIG. 4.
Figure 7:
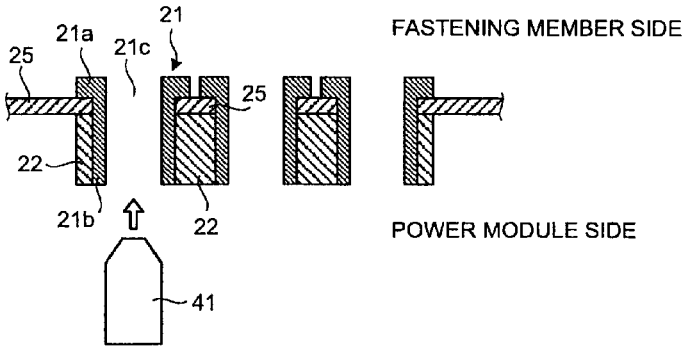
FIG. 7 is a diagram explaining swaging when the terminal connection structure according to the first embodiment is used.
Figure 8:
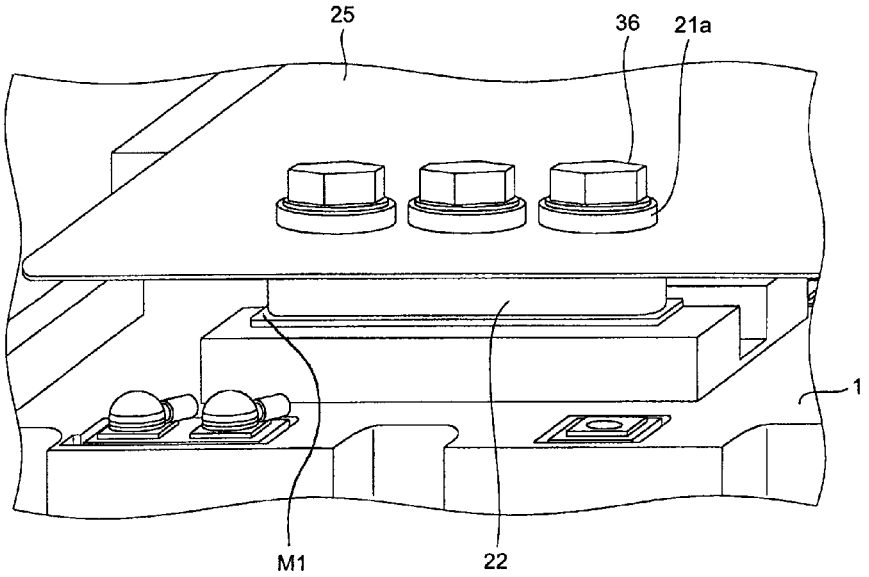
FIG. 8 is a perspective view illustrating an example when the power module is fastened by using the terminal connection structure according to the first embodiment.

Next, an explanation will be given, with reference to FIG. 3 to FIG. 8, of the terminal connection structure according to the first embodiment. FIG. 3 is a perspective view illustrating the outer shape of the parts that are components of the terminal connection structure according to the first embodiment. FIG. 4 is a partial cross-sectional perspective view illustrating an example when a conductor is swaged by using the terminal connection structure according to the first embodiment. FIG. 5 is a perspective view when the example in FIG. 4 is viewed from a direction A in FIG. 4. FIG. 6 is a perspective view when the example in FIG. 4 is viewed from a direction B in FIG. 4. FIG. 7 is a diagram explaining swaging when the terminal connection structure according to the first embodiment is used. FIG. 8 is a perspective view illustrating an example when the power module 1 is fastened by using the terminal connection structure according to the first embodiment.

The components of the terminal connection structure according to the first embodiment include male parts 21 illustrated in FIG. 3(*a*) and a female part 22 illustrated in FIG. 3(*b*). The male part 21 includes a base portion 21*a* and a shaft portion 21*b*, which is disposed vertically on the base portion 21*a*, and it has a configuration such that a hole portion 21*c* for inserting thereinto a fastening member, which will be described later, is provided at the axial center of a combination of the base portion 21*a* and the shaft portion 21*b*. The base portion 21*a* has a circular cross-sectional shape. The shaft portion 21*b* also has a circular cross-sectional shape with a smaller diameter than that of the base portion 21*a*.

The female part 22 has a rectangular or elliptical shape (hereinafter both shapes are collectively referred to as a "horizontally elongated shape") in cross section as illustrated in FIG. 3(*b*), and it is provided with three hole portions 22*a*, into which the shaft portions 21*b* of the male parts 21 are inserted, so as to correspond to the structure of the terminal electrode of the power module 1 illustrated in FIG. 1. In other words, the structure having three hole portions 22*a* is an example corresponding to the configuration in FIG. 1. A configuration having two or more hole portions 22*a* is within the scope of the present invention.

FIG. 3(*b*) illustrates the state where two male parts 21 are inserted into the hole portions 22*a*. In the mounted state, a conductor 25 is interposed between the female part 22 and the base portions 21*a*, as illustrated in FIG. 5 and FIG. 6, and the hole portions 21*c* of the male parts 21 located on the power module 1 side are swaged to secure the conductor 25, as illustrated in FIG. 4 and FIG. 7.

Swaging of the shaft portions 21*b* of the male parts 21 to the female part 22 can be performed by, as illustrated in FIG. 7, inserting a swage 41 from the side where the shaft portions 21*b* of the male parts 21 are present and widening the hole portions 21*c*, for example. Swaging methods are well known and it is obvious that methods other than that described here may also be used.

The swaged conductor 25 is fastened to the power module 1 by, as illustrated in FIG. 8, inserting bolts 36, which are fastening members, into the hole portions 21*c* of the male parts 21 and fastening the bolts 36 to the nuts 34 (see FIG. 1), which are fastening mechanisms provided in the first terminal electrode M1, the second terminal electrode M2, and the third terminal electrode M3. Thus, the conductor 25 is secured to the power module 1. The first embodiment describes an example in which the conductor 25 is secured to the power module 1 by using the bolts 36 and the nuts 34;

however, the nuts 34 become unnecessary by forming a screw structure in the holes 32 formed in the first terminal electrode M1, the second terminal electrode M2, and the third terminal electrode M3.

Figure 9:
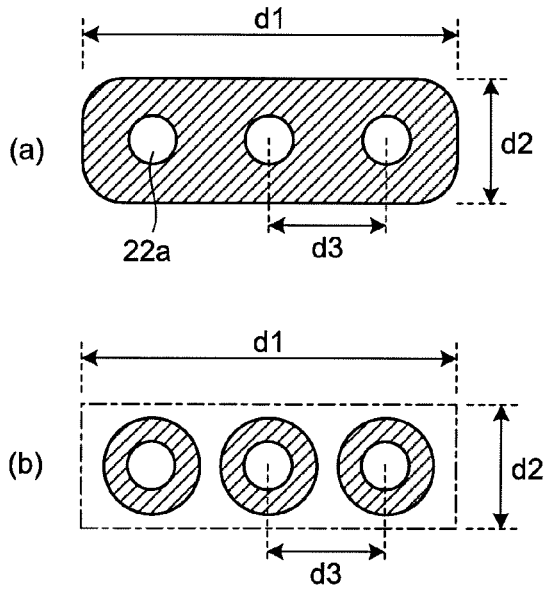
FIG. 9 is a diagram explaining the effect of the terminal connection structure according to the first embodiment.

Next, an explanation will be given, with reference to FIG. 9, of an effect of using the terminal connection structure according to the first embodiment. FIG. 9 is a diagram explaining the effect of the terminal connection structure according to the first embodiment.

In FIG. 9(*a*), d1 represents the length in the longitudinal direction of the female part 22 having an elliptical shape and d2 represents the length in a direction orthogonal to the longitudinal direction of the female part 22. The hatched portion represents the portion that comes into contact with the conductor 25. As illustrated in FIG. 9(*a*), the portion excluding the footprint of the hole portions 22*a* into which the bolts 36 are inserted comes into contact with the conductor 25.

In contrast, FIG. 9(*b*) illustrates, as in Patent Literature 1, a contact portion when a circular swaging member is provided for each connection terminal. In FIG. 9, in order to experience the same conditions as those illustrated in FIG. 3 in the first embodiment, the outer diameter of the base portion 21*a*, the outer diameter of the shaft portion 21*b*, and an interval d3 between the connection terminals are set the same.

As is apparent from the comparison of FIG. 9(*a*) and FIG. 9(*b*), the use of the terminal connection structure in the first embodiment can increase the area in contact with the conductor 25. As explained in the section "Technical Problem", because the power module having a plurality of fastening points is often used for high current applications, a reduction in the contact area ratio increases the current per unit area, i.e., the current density. A large current density poses a problem of an increase in the temperature of the contact portions, and this significantly affects the design.

In contrast, with the terminal connection structure in the first embodiment, the female part, which is a part located on the power module 1 side and is among the parts that are in contact with the conductor 25, is formed into a horizontally elongated shape; therefore, the area in contact with the conductor 25 can be increased compared with that in the conventional technologies. Therefore, the current density can be reduced.

As described above, according to the terminal connection structure in the first embodiment, the conductor is secured by being sandwiched between the male parts, which include the hole portions into which the fastening members are inserted, and the female part, into which the male parts are inserted and which includes hole portions equivalent in number to the connection terminals of the power module, and then swaging the hole portions of the male parts, and the power module is secured to the conductor with the fastening members inserted into the hole portions of the male parts and the fastening mechanisms provided to the connection terminals. In this way, the contact area ratio can be increased without reducing the swaging force. Therefore, an increase in the temperature of the contact portion can be suppressed.

Moreover, the terminal connection structure according to the first embodiment uses one female part with respect to a plurality of connection terminals. Thus, swaging operations can be performed continuously in a single operation. Therefore, the swaging operations can be performed efficiently.

Second Embodiment

Figure 10:
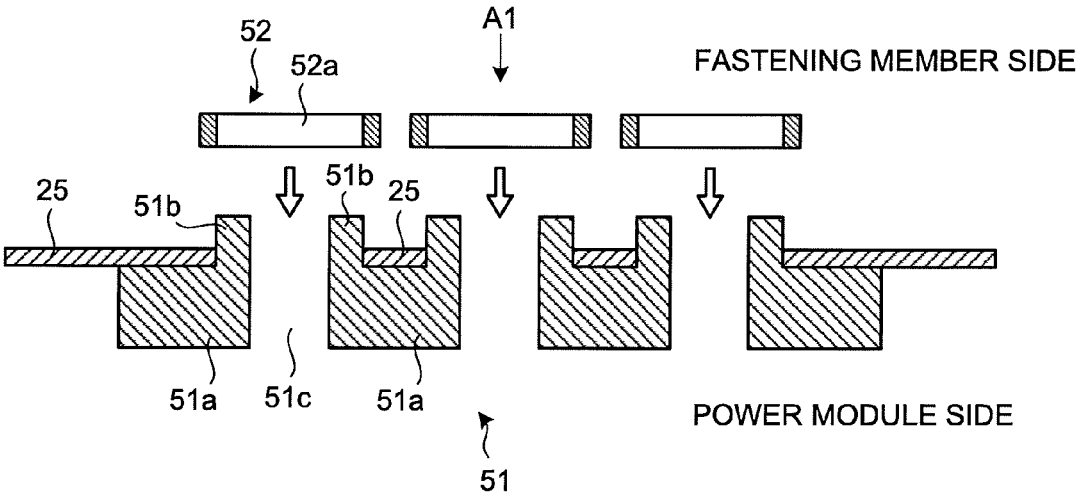
FIG. 10 is a cross-sectional view illustrating a terminal connection structure according to a second embodiment.

FIG. 10 is a cross-sectional view illustrating a terminal connection structure according to a second embodiment. The first embodiment employs a structure in which the female part is provided on the power module side and the male parts are provided on the fastening member side as illustrated in FIG. 7, for example; however, the second embodiment employs, as illustrated in FIG. 10, a structure in which the male part is provided on the power module side and the female parts are provided on the fastening member side. Specifically, on the power module side, a male part 51 is provided such that shaft portions 51*b* having a circular cross-sectional shape when viewed from a direction A1 are disposed vertically on a base portion 51*a* having a horizontally elongated cross-sectional shape when viewed from the direction A1, and three hole portions 51*c* into which fastening members are inserted are provided in a similar manner to the first embodiment. The number of the hole portions 51*c* is three so as to correspond to the configuration of the power module 1 illustrated in FIG. 1.

On the fastening member side, female parts 52 are provided. The female parts 52 are provided with hole portions 52*a* into which the shaft portions 51*b* of the male part 51 are inserted and are each formed into a circular cross-sectional shape when viewed from the direction A1. Unlike the first embodiment, the configuration is such that three separate female parts 52 are provided. The first embodiment employs, as illustrated in FIG. 7, the configuration in which swaging is performed by inserting the swage 41 from the power module side. In the second embodiment, swaging can be performed by inserting the swage 41 from the fastening member side.

With the terminal connection structure according to the second embodiment configured as above, the configuration is such that the male part and the female part in the structure in the first embodiment are interchanged. Thus, swaging is performed near the conductor that is to be sandwiched; therefore, the conductor can be secured by a smaller swaging force than that in the first embodiment.

Third Embodiment

Figure 11:
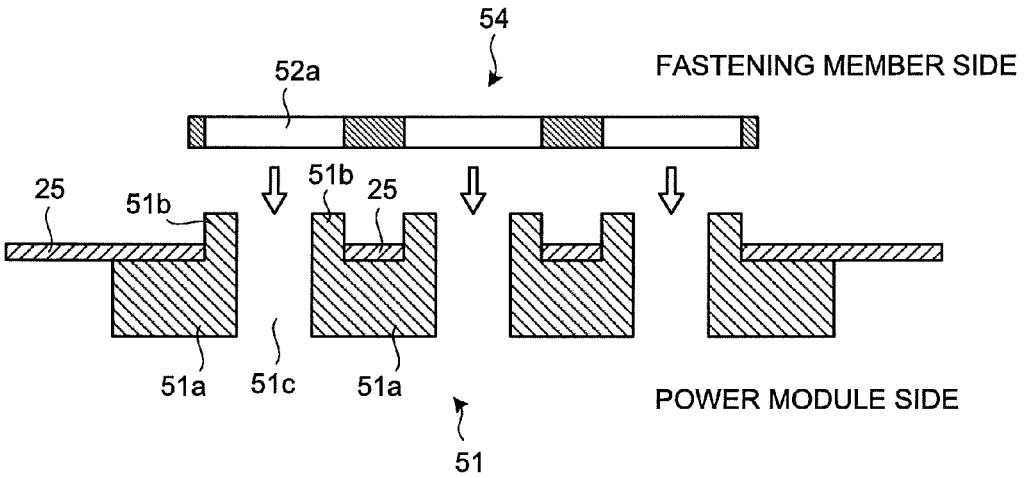
FIG. 11 is a cross-sectional view illustrating a terminal connection structure according to a third embodiment.

FIG. 11 is a cross-sectional view illustrating a terminal connection structure according to a third embodiment. In the second embodiment, the configuration is such that three female parts 52 are provided so as to correspond to the configuration of the terminal electrode of the power module 1. The third embodiment employs, as illustrated in FIG. 11, a configuration that includes a female part 54 that is formed into a horizontally elongated shape by connecting three female parts. In FIG. 11, the parts identical with or equivalent to those in FIG. 10 are denoted by the same reference numerals and a duplicated explanation is omitted. The position at which swaging is performed is similar to that in the second embodiment.

With the terminal connection structure according to the third embodiment configured as above, the configuration is such that the male part and the female part in the structure in the first embodiment are interchanged. Thus, swaging is performed near the conductor that is to be sandwiched; therefore, the conductor can be secured by a smaller swaging force than that in the first embodiment.

Moreover, with the terminal connection structure according to the third embodiment, because one female part is used with respect to a plurality of connection terminals, swaging operations can be performed continuously in a single operation. Therefore, the swaging operations can be performed efficiently.

Fourth Embodiment

Figure 12:
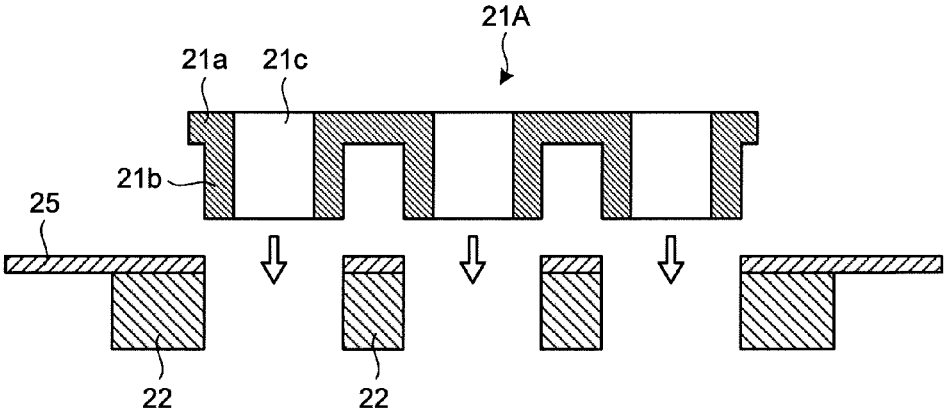
FIG. 12 is a cross-sectional view illustrating a terminal connection structure according to a fourth embodiment.

FIG. 12 is a cross-sectional view illustrating a terminal connection structure according to a fourth embodiment. In the first embodiment, as illustrated in FIG. 3, three male parts 21 are provided so as to correspond to the configuration of the terminal electrode of the power module 1. The fourth embodiment employs, as illustrated in FIG. 12, a configuration that includes a male part 21A that is formed into a horizontally elongated shape by connecting three male parts. In FIG. 12, the parts identical with or equivalent to those in FIG. 3 are denoted by the same reference numerals and a duplicated explanation is omitted. The position at which swaging is performed is similar to that in the first embodiment.

The terminal connection structure according to the fourth embodiment configured as above is equivalent in configuration to that in the first embodiment; therefore, effects similar to those in the first embodiment can be obtained.

Moreover, with the terminal connection structure according to the fourth embodiment, because one female part and one male part are used with respect to a plurality of connection terminals, swaging operations can be performed continuously in a single operation. Therefore, the swaging operations can be performed efficiently.

Fifth Embodiment

Figure 13:
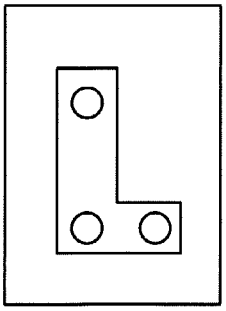
FIG. 13 is a plan view illustrating a terminal shape of a power module for explaining a terminal connection structure according to a fifth embodiment.

In the first embodiment, as illustrated in FIG. 1, an explanation has been given of a case where the terminal electrodes of the power module 1 have a horizontally elongated shape. In a fifth embodiment, as an example other than a horizontally elongated shape, the terminal electrodes are L shaped as illustrated in FIG. 13. In the case of such an L shape, it is satisfactory if the female part or the male part is formed into an L shape so as to correspond to the shape of the terminal electrodes. Accordingly, by making use of this method, it is possible to accommodate any shape.

The first to fifth embodiments have been explained with a power module as an example; however, they can be applied to any electronic component that needs an electrical connection with a conductor.

The configurations illustrated in the first to fifth embodiments above are examples of the configuration of the present invention and can be combined with other publicly known technologies and it is obvious that they can be changed, for example, by omitting part thereof without departing from the scope of the present invention.

INDUSTRIAL APPLICABILITY

As described above, the present invention is useful as a terminal connection structure for electrically connecting a terminal of an electronic component and a conductor.

REFERENCE SIGNS LIST

1 power module, 2 package, 10 first element pair, 10*a* connection portion, 10*b* connection portion, 12 second element pair, 12*a*, 12*b* connection portion, 21, 21A, male part, 21*a* base portion, 21*b*, 51*b* shaft portion, 21*c*, 51*c* hole portion (male part), 22, 52, 54 female part, 22*a*, 52*a* hole portion (female part), 25 conductor, 32 hole, 34 nut (fastening mechanism), 36 bolt (fastening member), 41 swage.

The invention claimed is:

1. A terminal connection structure comprising:

a terminal electrode provided on an electronic component;

a male part that includes a shaft portion in which a hole portion is provided;

a female part that includes a plurality of hole portions into which the shaft portion is inserted; and a conductor that is sandwiched between the female part and the male part and is electrically connected to the terminal electrode by the female part, wherein the conductor is secured by swaging the hole portion of the male part, and the female part with the hole portions is provided between the conductor and the terminal electrode.

2. A terminal connection structure comprising:

a terminal electrode provided on an electronic component;

a male part that includes a plurality of shaft portions in which a hole portion is provided;

a female part that includes a hole portion into which the shaft portion is inserted; and a conductor that is sandwiched between the female part and the male part and is electrically connected to the terminal electrode by the male part, wherein the conductor is secured by swaging the hole portions of the male part.

3. The terminal connection structure according to claim 1, wherein the male part includes a base portion having a circular cross-sectional shape and the shaft portion disposed vertically on the base portion and having a circular cross-sectional shape with a smaller diameter than a diameter of a cross section of the base portion.

4. The terminal connection structure according to claim 1, wherein the male part includes a base portion having a horizontally elongated cross-sectional shape and a plurality of the shaft portions each of which is formed into a circular cross-sectional shape and is disposed vertically on the base portion.

5. The terminal connection structure according to claim 2, wherein the shaft portions of the male part are inserted into a plurality of the female parts.

6. The terminal connection structure according to claim 2, wherein the female part includes a plurality of the hole portions.

7. The terminal connection structure according to claim 1, further comprising a fastening member that is inserted into the male part to secure the conductor to the electronic component.

8. The terminal connection structure according to claim 1, wherein the terminal electrode is L-shaped.

9. The terminal connection structure according to claim 2, wherein the male part includes a base portion having a horizontally elongated cross-sectional shape and a plurality of the shaft portions each of which is formed into a circular cross-sectional shape and is disposed vertically on the base portion.

10. The terminal connection structure according to claim 2, further comprising a fastening member that is inserted into the male part to secure the conductor to the electronic component.

11. The terminal connection structure according to claim 2, wherein the terminal electrode is L-shaped.

* * * * *